US005967001A

United States Patent [19]

Regester

[11] Patent Number: 5,967,001

[45] Date of Patent: Oct. 19, 1999

[54] CAP REMOVING TOOL

[75] Inventor: David J. Regester, West Grove, Pa.

[73] Assignee: Qualicon, Wilmington, Del.

[21] Appl. No.: 09/013,315

[22] Filed: Jan. 26, 1998

[51] Int. Cl.[6] ..... B67B 7/16

[52] U.S. Cl. ..... 81/3.55; 81/3.09

[58] Field of Search ..... 81/3.09, 3.55, 81/3.57

[56] References Cited

U.S. PATENT DOCUMENTS 4,858,502 8/1989 Warburg ..... 81/3.57

5,253,551 10/1993 DeVaughn ..... 81/3.55 X

OTHER PUBLICATIONS

MicroAmp® Cap Installing Tool, *Perkin Elmer 1996–1997 Catalogue*, p. 59.

Cap–It, *Advanced Biotechnology 1997/98 Catalogue*, p. 31.

*Primary Examiner*—James G. Smith

[57] ABSTRACT

A tool is provided for use in near simultaneous removal of a plurality of caps from a strip of PCR reaction tubes held in a tube rack (and, in an alternate embodiment, for also recapping the tubes) without disturbing the contents thereof.

6 Claims, 2 Drawing Sheets

CAP REMOVING TOOL

BACKGROUND OF THE INVENTION

This invention relates to the field of apparatus for performing polymerase chain reaction ("PCR") and, more particularly, to a tool for removing and installing caps of PCR reaction tubes.

PCR is a widely used procedure in which a small amount of DNA is amplified (i.e., reproduced) to yield a higher concentration of the DNA for further study, testing, etc. See U.S. Pat. No. 4,683,195 and U.S. Pat. No. 4,683,202. The steps of the reaction require the samples to undergo a series of thermal treatments wherein the samples are repeatedly cycled between two temperatures, such as between 70° C. and 94° C. about 35 times. It has become common to perform PCR in reaction tubes. The reaction tubes are small plastic containers (each holding approximately 0.2 ml) having a generally cylindrical shape with a conical bottom and a removable cap at the top. Because of their small size, the tubes are commonly sold connected together in strips of 8 or 12 tubes. An equal number of caps is provided as a matching strip. A strip of caps has tabs at each end to facilitate removal of the strip.

Twelve strips of 8 tubes ordinarily are loaded into wells in a tube rack for processing. In some apparatus, four such tube racks are processed simultaneously. In use, the operator loads a strip of capped tubes into the tube rack and removes the strip of caps by pulling on the tab to lift the caps progressively from one end to the other. The tubes are then loaded with the appropriate reagents, usually with a micropipette and recapped by hand. The procedure of uncapping and recapping is repeated after the PCR process to remove the samples for analysis.

If the tubes are empty, the act of removing the strip of caps in rapid succession obviously does not present any problem of ejecting the contents. However, when necessary to uncap the tubes when they are full or partially full (as in the case of tubes purchased pre-packaged with reagents), it is often the case that some of the contents will be released. It is even sometimes the case that recapping the tubes might result in spillage of some of the contents. To minimize spillage, the technician will typically need to carefully remove and/or replace one cap at a time, which is not only tedious and time consuming, but also requires repetitive movements. Also, spillage of DNA material is highly undesirable because of the potential for contamination of adjacent and subsequent reactions. Moreover, practice has shown that the closely packed tubes in the tube rack are difficult to recap. A careless or hurried technician may not always get all tubes properly recapped all of the time which can result in test failures due to evaporation during heating. Even when the tubes are uncapped while empty, removing strips of caps by hand often results in stretching of the strip making recapping difficult and subject to failure.

SUMMARY OF THE INVENTION

It is, therefore, an object of this invention to provide a tool for easy uncapping and/or recapping of strips of PCR reaction tubes and the like without disturbance of the contents thereof.

In one aspect, the invention provides a tool for use in near simultaneous uncapping of a plurality of linearly-oriented, spaced-apart tubes, the tool comprising:

a) a body having a first portion for engagement by a user and a second portion adapted to engage a plurality of caps while said caps are in locked engagement with a plurality of corresponding tubes;

b) said second portion comprising a channel defined by two longitudinally oriented and spaced-apart walls of unequal depth, wherein the space between the walls is such as to provide a close fit with the plurality of caps engaged therein; wherein the wall of greater depth has a depth such that when the wall of lesser depth is seated on a cap and a rocking motion is applied to said body in a direction substantially transverse to the longitudinal orientation of a plurality of caps, the wall of lesser dimension will engage the plurality of caps and an upward force will be exerted to uncap a plurality of tubes.

In a second aspect, the invention further provides a tool for both removing and recapping a plurality of linearly-oriented, spaced-apart tubes, the tool comprising:

a) a body having a first portion for engagement by a user and a second portion adapted to engage a plurality of caps while said caps are in locked engagement with a plurality of corresponding tubes;

b) said second portion comprising a channel defined by two longitudinally oriented and spaced-apart walls of unequal depth, wherein the space between the walls is such as to provide a close fit with the plurality of caps engaged therein; wherein the wall of greater depth has a depth such that when the wall of lesser depth is seated on a cap and a rocking motion is applied to said body in a direction substantially transverse to the longitudinal orientation of a plurality of caps, the wall of lesser dimension will engage the plurality of caps and an upward force will be exerted to uncap a plurality of tubes; and c) the first portion of the body having a plurality of linearly-oriented, spaced-apart recesses, wherein each recess is adapted to engage a cap therein and wherein the plurality of recesses is aligned to correspond to the position of a plurality of capped tubes to facilitate the near simultaneous capping of a plurality of tubes.

These and other aspects of the invention will become apparent upon a further reading of the specification with reference to the drawings and the appended claims. The invention is described and illustrated with particular reference to its use in uncapping and capping PCR tubes. It is to be understood, however, that the invention is not intended to be limited to that particular use and that the invention may be equally useful to uncap and cap any small container, or even may find utility in safely breaking small ampules.

DETAILED DESCRIPTION OF THE INVENTION

Figure 1:
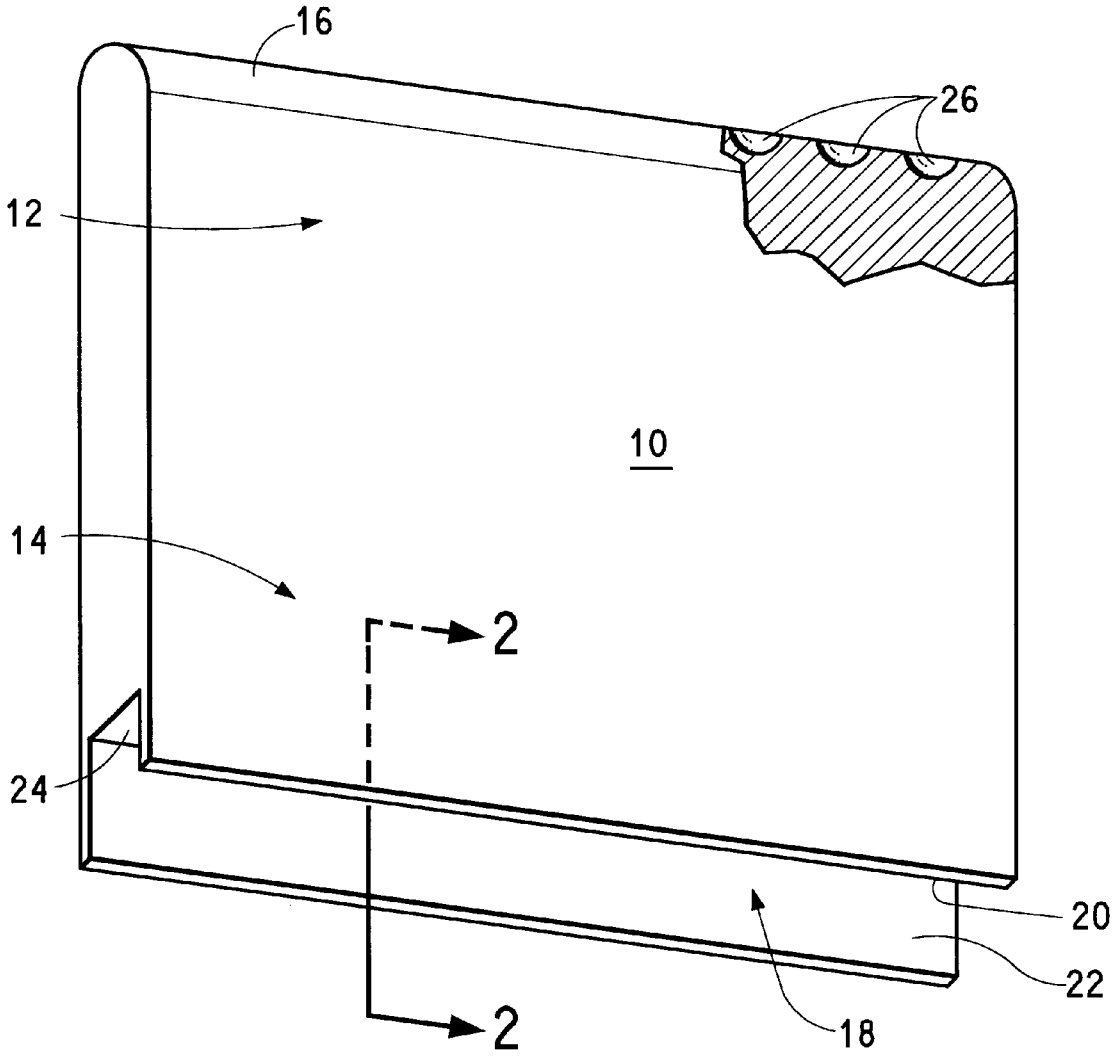
FIG. 1 is a perspective view of a preferred embodiment of the tool of the invention, partially sectioned, particularly illustrating the plurality of spaced-apart recesses used in recapping the tubes.

With reference first being made to FIG. 1, a preferred embodiment of the tool of the invention is illustrated therein.

As seen in FIG. 1, the tool comprises a body 10 having a first portion 12 adapted for engagement by a user and a second portion 14 adapted to engage a plurality of caps.

In the embodiment illustrated, the body 10 has a generally rectangular, box-like configuration. It is understood, however, that the precise configuration of the body 10 is not critical to the invention and that the shape is more a matter of intended end use, user convenience or ergonomic and aesthetic considerations. Furthermore, the body 10 may be made of any type of relatively rigid material, such as plastic, metal, wood, etc. and may be machined, injection molded or extruded to provide the desired configuration. The embodiment shown in FIG. 1 incorporates a rounded edge 16 in the first portion 12 of body 10 for the comfort of the user and is made of 6061 aluminum.

Figure 2:
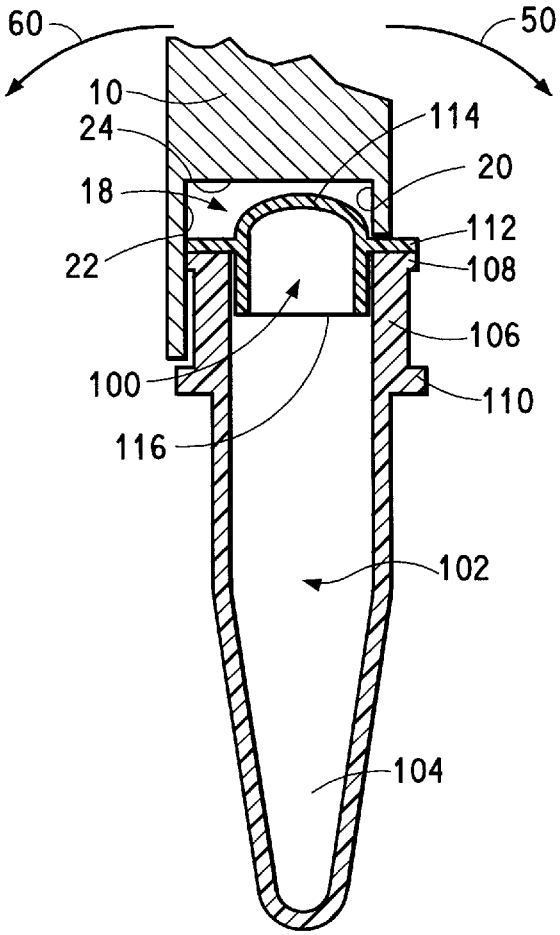
FIG. 2 is a sectioned, partly fragmented, elevational view of the tool of the invention in operational engagement with a typical PCR tube.

The second portion 14 of body 10 is provided with a longitudinal channel 18, defined by two opposing side walls 20, 22 of unequal depth, and bottom wall 24. With reference now being made to FIG. 2, the tool of this invention, specifically the channel 18, is shown engaged with a cap 100 of a typical PCR tube 102. As mentioned above, PCR tubes 102 are generally commercially available in strips of 8 or 12 tubes connected together by webs in a linear orientation and the caps 100 are likewise available in companion strips of 8 or 12. In the view shown in FIG. 2, the strip of tubes and caps would be oriented into and out of the plane of the paper.

As seen in FIG. 2, the PCR tube is of generally cylindrical shape with a conical lower portion 104. The upper portion of the tube 102 is characterized by a thickened area 106 that surrounds the opening of the tube and by upper and lower flanges 108, 110, respectively. Lower flange 110 serves to maintain the tube at a proper depth in a tube rack, fluorometer, or similar apparatus used in PCR analysis whereas upper flange 108 provides strength to the mouth of the tube and a "seat" for the flange 112 of cap 100. The upper surface 114 of cap 100 is shown with a rounded or domed configuration, which is typical. Other configurations, however, are possible without affecting the invention. Further, it is understood that any or all of flanges 108, 110 and 112 may be full circumferential flanges or partial flanges. In most PCR tubes, the flanges 108 and 110 are full flanges and flange 112 comprises two partial flanges oriented 180 degrees from one another.

As illustrated in FIG. 2, the channel 18 is dimensioned to closely engage the caps 100. More specifically, the side walls 20, 22 defining the channel are of unequal depth. The side wall of lesser depth 20 has a dimension at least equal to the distance between the top of dome 114 to the flange 112. The side wall of greater depth 22 has a dimension such that, when wall 20 is seated in position and the tool is pivoted about the lower edge of wall 22 (in the direction of arrow 60 of FIG. 2), the lower edge of wall 20 will engage the caps with sufficient force to cause the caps to be removed from their respective tubes. The width of the channel 18 is dimensioned to closely correspond to the dimension between the wall of cap 100 and the edge of flange 112. For use with standard strips of PCR tubes available from Evergreen Scientific, Los Angeles, Calif. (Part No. 214-3546-080) or Corning Costar Corp., Cambridge, Mass. (Part No. 6542) and a standard 96 tube rack (e.g., from MJResearch, Inc., Watertown, Mass. as Part No. TRC-0501), the tool is 7.6 cm (3 inch) long by 5.1 cm (2 inch) high by 0.792 cm (0.312 inch) thick and is fabricated from 6061 aluminum. The channel 18 is 0.584 cm (0.230 inch) wide. The depth of side wall 20 is 0.279 cm (0.110 inch) and the depth of side wall 22 is 0.635 cm (0.250 inch). The thickness of the walls 20, 22 is not particularly important. Certainly, they should be thick enough to provide the requisite strength needed to operate the tool. If the tool is intended to be used on tubes held in a tube rack, the walls should not be so thick as to interfere with the next adjacent row of tubes. Other than these considerations, the thickness of the walls may be of any desired dimension.

In use, the tool is positioned over a strip of capped tubes such that the caps 100 are disposed within channel 18 as shown in FIG. 2. The tool is then moved in a rocking motion toward the shorter wall 20 of channel 18; i.e., in the direction of arrow 50 of FIG. 2. The tool is then rocked in the opposite direction (i.e., the direction of arrow 60 in FIG. 2) which removes all caps 100 simultaneously (or near simultaneously) with forces directed transverse to, and against the resistance of, the entire strip of tubes 102. The forces applied to the row of caps 100 may be considered to act tangentially to the arc of motion of the tool to establish a prying action. As a result of that prying action, which is uniformly resisted, no shock is transmitted to the contents of tubes 102 and the contents are not ejected.

In an alternate embodiment as seen in FIG. 1, the tool body 10, more specifically at the rounded end 16 opposite the location of channel 18, is provided with a plurality of, spaced-apart recesses 26. Each recess is configured to engage a cap 100 therein and the recesses 26 are spaced to coincide with the location of the caps 100 when placed in the tubes 102. In the embodiment shown in FIG. 1, the recesses 26 comprise a series of eight concave recesses of 0.64 cm (0.25 inch) diameter, 0.20 cm (0.080 inch) deep and spaced 0.9 cm (0.354 inch) apart with the first recesses being spaced 0.663 cm (0.261 inch) from each edge of the tool. Again it is understood that the invention is not limited to these specific dimensions. The recesses 26 are used to apply near simultaneous pressure to the plurality of caps 100. In use, the user would align the strip of caps by hand and then use the recesses 26 to apply pressure to the caps 100 and seat them into tubes 102.

Figure 3:
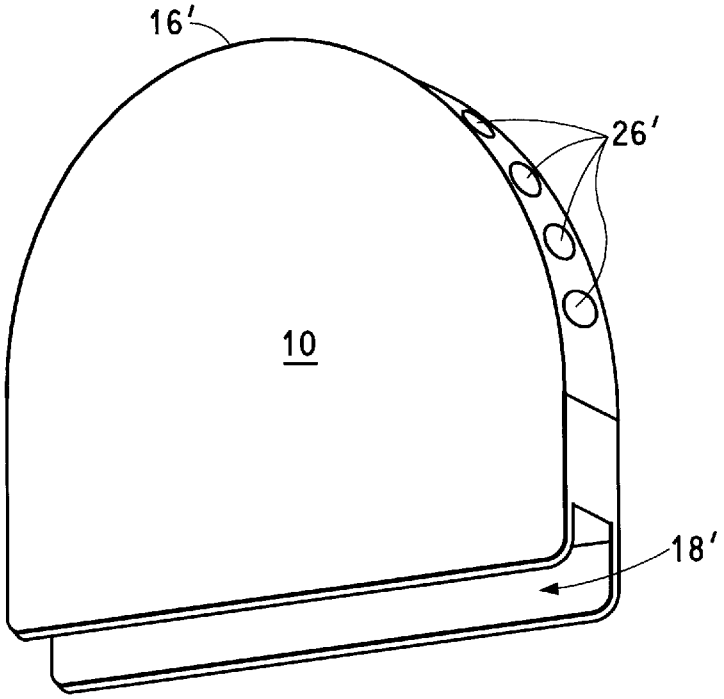
FIG. 3 is a perspective view, partly sectioned, of a preferred embodiment, illustrating the semi-circular configuration of the recapping end of the tool.

In practice, the embodiment shown in FIG. 1 may require more force than is practical, particularly if 8 or twelve caps are being applied nearly simultaneously. For this reason, the configuration of the tool shown in FIG. 3 is preferred. As seen in FIG. 3, the edge 16' opposite the channel 18' of tool body 10' has a semi-circular or arcuate configuration. The recesses 26' are positioned to engage the caps of successive tubes as the tool is rolled along arcuate edge 16' which permits the caps to be seated in the respective tubes in succession, rather than simultaneously, and requires significantly less force.

What is claimed is:

1. A tool for use in near simultaneous uncapping of a plurality of linearlyoriented, spaced-apart tubes, the tool comprising:

(a) a body having a first portion for engagement by a user and a second portion size to simultaneously engage a plurality of caps while a plurality of caps are in fastened engagement with a plurality of corresponding tubes;

(b) said second portion comprising a channel defined by two longitudinally oriented and spaced-apart walls of unequal depth, wherein the space between the walls is such as to provide a close fit with the plurality of caps engaged therein; wherein the wall of greater depth has a depth such that when the wall of lesser depth is seated on a cap and a rocking motion is applied to said body in a direction substantially transverse to the longitudinal orientation of a plurality of caps, the wall of lesser dimension will engage the plurality of caps and an upward force will be exerted to uncap a plurality of tubes.

2. The tool of claim 1, further comprising the first portion of the body having a plurality of linearly-oriented, spaced-apart recesses, wherein each recess is adapted to engage a cap therein and wherein the plurality of recesses is aligned to correspond to the position of a plurality of capped tubes to facilitate capping of a plurality of tubes.

3. The tool means of claim 2, wherein the tool comprises a substantially rectangular box-like configuration having two opposing sides of longer length and wherein the channel is located on one of the sides of longer length.

4. The tool of claim 3 wherein the side of longer length opposite the channel is rounded and contains the plurality of recesses.

5. The tool of claim 3, wherein said body is made of a material selected from the group consisting of metal, plastic and wood.

6. The tool of claim 2, wherein the second portion is straight and wherein the first portion is semi-circular and the plurality of recesses are spaced along the circumference of the semi-circle.

* * * * *